US006478058B1

(12) United States Patent
Pears

(10) Patent No.: US 6,478,058 B1
(45) Date of Patent: Nov. 12, 2002

(54) SPOUT WITH CUT-AWAY OPENINGS

(75) Inventor: Michael Pears, Scarborough (CA)

(73) Assignee: Scepter Corporation, Scarborough (CA)

( * ) Notice: Subject to any disclaimer, the term of this patent is extended or adjusted under 35 U.S.C. 154(b) by 0 days.

(21) Appl. No.: 09/895,248

(22) Filed: Jul. 2, 2001

(30) Foreign Application Priority Data

Jun. 28, 2001 (CA) ..... 2351835

(51) Int. Cl.[7] ..... B65B 1/04; B65B 3/00; B67C 3/00

(52) U.S. Cl. ..... 141/353; 141/255; 141/264; 141/285; 141/296; 141/351; 141/366; 222/567; 222/568; 222/571

(58) Field of Search ..... 141/255, 258, 141/264, 284, 285, 291, 296, 331, 335, 336, 344, 351, 353, 366, 391, 392; 222/566–571, 484, 514, 518, 525

(56) References Cited

U.S. PATENT DOCUMENTS

| | | | | |
|---|---|---|---|---|
| 3,540,402 A | | 11/1970 | Kocher | |
| 3,595,281 A | | 7/1971 | Laub | |
| 4,598,743 A | | 7/1986 | Milling | |
| 4,667,710 A | | 5/1987 | Wu | |
| 4,834,151 A | | 5/1989 | Law | |
| 5,076,333 A | | 12/1991 | Law | |
| 5,172,740 A | * | 12/1992 | Simmel et al. | 141/321 |
| 5,249,611 A | | 10/1993 | Law | |
| 5,419,378 A | | 5/1995 | Law | |
| 5,491,549 A | | 2/1996 | Wichner et al. | |
| 5,609,195 A | * | 3/1997 | Stricklin et al. | 141/346 |
| 5,628,352 A | | 5/1997 | Gracyalny et al. | |
| 5,704,408 A | | 1/1998 | Law | |
| 6,227,419 B1 | * | 5/2001 | Raboin | 222/484 |

OTHER PUBLICATIONS

State of California Air Resources Board, "Notice of Public Availability of Modified Text—Public Hearing to Consider the Adoption of Portable Fuel Container Spillage Control Regulations" with the enclosures, 36 pages, 1999.

* cited by examiner

*Primary Examiner*—Timothy L. Maust
(74) *Attorney, Agent, or Firm*—Blake, Cassels & Graydon LLP; Brian W. Gray

(57) ABSTRACT

A pouring spout is described that has sections cut away from the sleeve of the spout contiguous to an exit, as well as a means for setting the maximum distance the inner sleeve can be pushed past the outer sleeve of the spout.

26 Claims, 10 Drawing Sheets

SPOUT WITH CUT-AWAY OPENINGS

BACKGROUND OF INVENTION

Traditionally, spouts for containers for gasoline (as might be used to fill the tank of a lawnmower) or other volatile liquids are generally of a hollow conical or tubular shape, with the narrow end open to allow liquid to pour and the wider end threaded to be attached in an airtight fashion to the outlet port of the container.

While such a spout by itself will allow the gasoline to be poured when the container is tipped, such an arrangement would lead to "glugging" or intermittent slowing and surging of the gasoline flow through the spout as the air pressure in the container is intermittently equalized with the ambient air pressure. This can lead to splashing, spilling and other loss of gasoline. To prevent this, it is common to have a vent opening located on the container. Typically, the vent is located away from the outlet port in a position to allow gasoline to be poured without spilling gasoline through the vent. During pouring, the vent allows air into the tank to equalize the air pressure in the tank to the ambient air pressure.

Typically, both the vent and outlet are constructed such that they may be sealed when gasoline is not to be poured from the container or during storage.

Improvements to this basic pouring system are known.

One improvement provides for parallel channels running through the spout: at least one channel to permit a flow of the gasoline, and at least one separate channel to allow air to flow into the container. This spout allows the gasoline to be poured without "glugging" without the use of a separate vent. To work properly, the air channel should be kept free of gasoline "plugs". To facilitate this, it is known to have a tube extending from the air channel(s) of the spout deep into the container, and exiting in an area of the container which is usually free of gasoline, such as in a hollow handle.

Locating the channel(s) in the spout may, with a proper design, also allow the automatic "cut-off" of gasoline flow when a certain level of gasoline in the tank is reached. As noted above, gasoline flows during pouring unless the air pressure in the pouring container drops below a certain level. If the level of gasoline in the receiving tank reaches a level high enough to cover the inlet for the air channel (and the outlet for the gasoline channel) in the spout during pouring, the flow of air into the pouring container is stopped, the air pressure in the pouring container drops, and the flow of gasoline into the receiving tank also stops.

A second known improvement is to equip the pouring end of the spout with an end cap, and a spring biasing an outer sleeve into a closed position, thus creating a slide valve. With this improvement, the container with spout attached may be tipped or even inverted without release of the gasoline. The spout may also be left attached when the container is stored without venting of gasoline fumes.

The outer sleeve may be equipped with a protuberance, designed to catch the edge of a rim around the inlet port of the receiving tank during pouring, pushing against the spring and opening the slide valve. Pouring of gasoline from the container into the tank may then proceed in the normal manner. When the spout is withdrawn from the tank, the spring closes the slide valve, and splashing of the gasoline is prevented.

Environmental concerns have been of increasing concern to government regulators. As a result, some jurisdictions, such as the State of California, have been considering enacting or have enacted regulations concerning the construction and function of containers for the storage and pouring of volatile chemicals, including gasoline. The possible requirements include: making a slide valve mandatory, the containers and spouts meeting a minimum flow-rate requirement, and the containers and spouts being designed to allow the level of gasoline in the tank to be filled only to a maximum height.

SUMMARY OF THE INVENTION

The present invention is an improvement to the slide valve arrangement previously described and includes a "cut-away" section at the end of the gasoline-flow channel inserted into the gas tank. Use of this cut-away allows the gasoline flow-rate to be better controlled when beginning pouring with a flow-rate in a chosen range in an economic and efficient manner. In addition, the spout is constructed such that the outer sleeve may not be pushed past a certain point on the inner sleeve, allowing the maximum level to which a gas tank may be filled to be set and controlled.

In one aspect the present invention provides a spout comprising: a tubular inner sleeve for pouring liquids through an intake end of the sleeve to a pouring end of the sleeve; the inner sleeve positioned within a larger tubular outer sleeve, so that the outer sleeve is positioned for movement along the outside of the inner sleeve; the pouring end of the inner sleeve having at least two apertures and an end-cap larger than the inner diameter of the end of the outer sleeve closest to the pouring end of the inner sleeve; the outer sleeve being biased towards the end-cap to form a slide valve; and a stop mechanism to prevent movement of the inner sleeve in the direction of the pouring end relative to the outer sleeve in at least two pre-selected positions.

In an additional feature of this aspect of the invention, the spout of claim 1 further comprises the outer sleeve rotating relative to the inner sleeve to select one of the pre-selected positions. In another additional feature of this aspect of the invention, the stop mechanism further comprises at least two keyways in the outer sleeve and a key on the inner sleeve. In yet another additional feature of this aspect of the invention, the outer sleeve has a protrusion for catching upon the rim of the inlet port of a container. In yet another additional feature of this aspect of the invention, the protrusion is a flange.

In another additional feature of this aspect of the invention the diameter of the pouring end of the inner sleeve is small enough in diameter to fit through the inlet port of a container and the outer sleeve is larger in diameter than the inlet port of the container. In yet another additional feature of this aspect of the invention, the outer sleeve has at least two sections of unequal diameter, and the section of the outer sleeve at the end closest to the pouring end of the inner sleeve being smaller in diameter than at least one other section. In still another additional feature of this aspect of the invention, the intake end of the inner sleeve is attached to a port of a container.

In another additional feature of this aspect of the invention, the sleeve has at least one cut away section, cut away from the sidewalls of the sleeve contiguous with at least one aperture. In still another additional feature of this aspect of the invention, the spout further comprises a tube inside the inner sleeve and attached to an aperture that is not contiguous to a cut away section. In another additional feature of this aspect of the invention, the tube is flexible. In still another additional feature of this aspect of the invention, there is a flow diverter between the at least two apertures and the end cap. In yet another additional feature of this aspect of the invention, the flow diverter has a recess for air flow which is partially covered when the inner sleeve and outer sleeve are in at least one of the at least two pre-selected positions.

In a second aspect, the present invention provides a spout comprising: a first tubular sleeve for pouring liquids, the sleeve having an intake end and a pouring end, the pouring end having side walls and an end wall; the end wall having at least two apertures there through; and the first sleeve having at least one cut away section, cut away from the sidewalls of the first sleeve contiguous with at least one aperture. In another additional feature of this aspect of the invention, the cut away section is a semi-circle in shape.

In yet another additional feature of this aspect of the invention, the spout further comprises: a channel connected to at least one aperture, the at least one aperture connected to the channel not being contiguous with a cut away section; the cut away section being sized to create a specific ratio of the effective cross-sectional area of the channel to the effective cross-sectional area of the apertures including the cut away section not connected to the channel. In another additional feature of this aspect of the invention, the spout further comprises: a channel connected to at least one aperture, the at least one aperture connected to the channel not being contiguous with a cut away section; a flexible tube being connected to the channel, the flexible tube having an end connected to the channel and an end not connected to the channel; the cut away section being sized to create a specific ratio of effective cross-sectional area of the end of the flexible tube not connected to the channel to the effective cross-sectional area of the apertures including the cut away section not connected to the channel.

In another additional feature of this aspect of the invention, the end of the flexible tube not connected to the channel is mitred. In still another additional feature of this aspect of the invention, the end of the flexible tube not connected to the channel is irregularly cut. In yet another additional feature of this aspect of the invention, the spout further comprises: a channel connected to at least one aperture; and the cut away section being sized to allow a specific minimum flow-rate of liquids being poured through the spout when in use.

In another additional feature of this aspect of the invention, the spout further comprises: a channel connected to at least one aperture; and the cut away section being sized to allow a specific maximum flow-rate of liquids being poured through the spout when in use.

In another additional feature of this aspect of the invention, the spout is attached to a container.

In another additional feature of this aspect of the invention, the spout further comprises: the first sleeve positioned within a larger tubular outer second sleeve, so that the second sleeve is positioned for movement along the outside of the first sleeve; the pouring end of the first sleeve having an end-cap larger than the inner diameter of the end of the second sleeve closest to the pouring end of the first sleeve; the second sleeve being biased towards the end-cap to form a slide valve; and a stop mechanism to prevent movement of the first sleeve in the direction of the pouring end relative to the second sleeve in at least two pre-selected positions.

In another additional feature of this aspect of the invention, the second sleeve rotates relative to the first sleeve to select one of the pre-selected positions. In yet another additional feature of this aspect of the invention, the stop mechanism further comprises at least two keyways in the second sleeve and a key on the first sleeve. In still another additional feature of this aspect of the invention, the second sleeve has a protrusion for catching upon the rim of the inlet port of a container. In another additional feature of this aspect of the invention, the protrusion is a flange. In still another additional feature of this aspect of the invention, there is a flow diverter between the at least two apertures and the end cap. In yet another additional feature of this aspect of the invention, the flow diverter has a recess for air flow which is partially covered when the inner sleeve and outer sleeve are in at least one of the at least two pre-selected positions.

In all cases, the spout may be attached to a container.

DETAILED DESCRIPTION

Figures 1A, 1B:
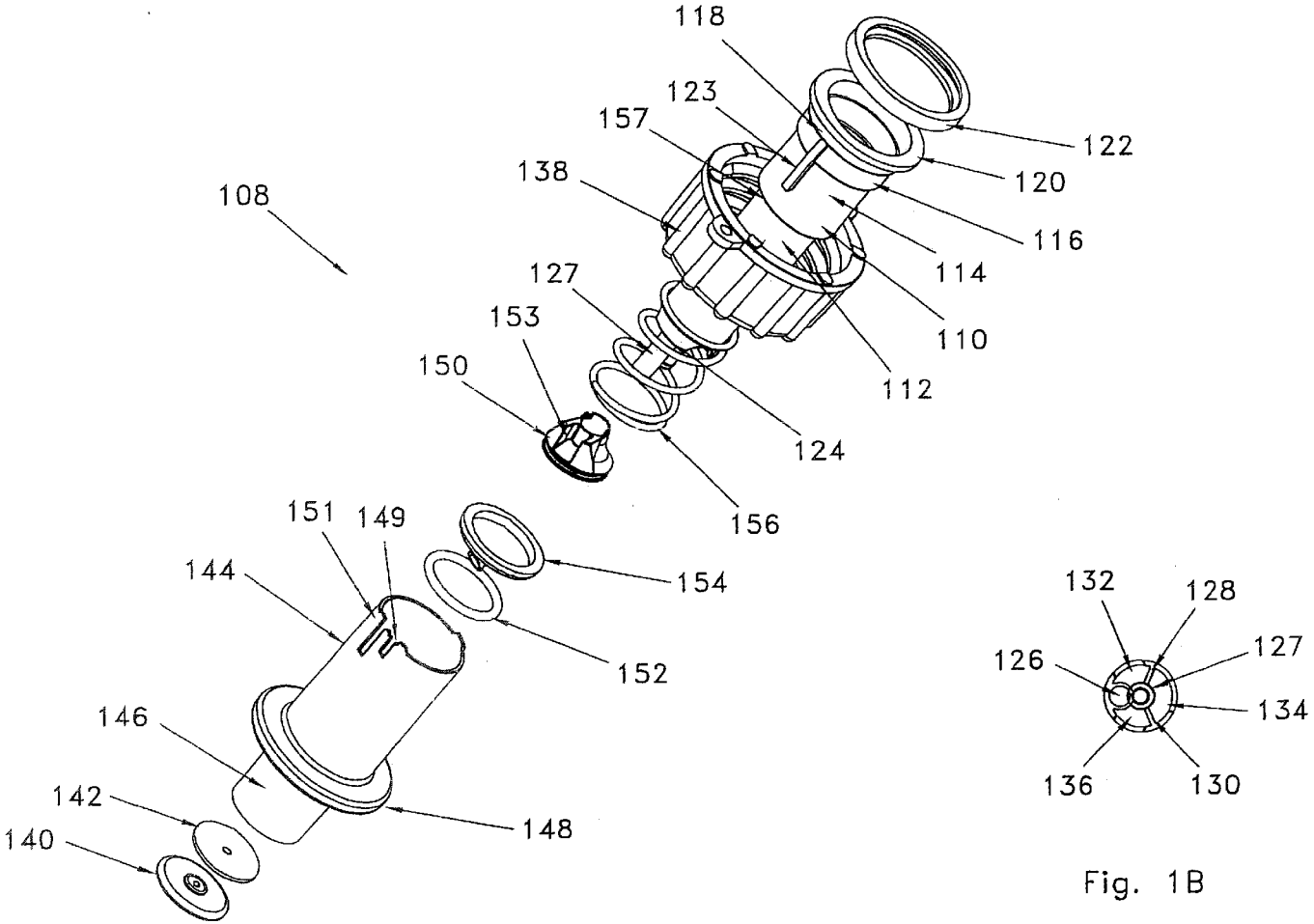
FIG. 1*a* is an exploded assembly view of the pour spout.
FIG. 1*b* is an end-on view of the end of the inner sleeve of the pour spout of FIG. 1*a;*

Spout 108 is shown in exploded view in FIG. 1*a*. Turning to FIG. 1*a*, spout 108 has a plastic tubular inner sleeve 110, comprising several sections of gradually increasing outside diameter: section 112, section 114, section 116, section 118, and a flange 120. In the preferred embodiment, these sections have radiuses varying from 2 mm down to 0.5 mm (0.080 inches down to 0.020 inches), but these radii may be varied considerably without affecting the workings of the invention embodied in pour spout 108. Flange 120 is covered with a rubber o-ring 122, shaped to fit on flange 120. A key 123 is raised from the surface of section 114 (or section 114 and section 116) of tubular inner sleeve 110.

Endwall 124 of section 112 is molded to create several different apertures pierced through the endwall. An end-on view of endwall 124 is given in FIG. 1*b*. Turning to FIG. 1*b*, endwall 124 is molded to create a circular aperture 126, which is molded into the wall of section 112 and to a central tube 127. Central tube 127 has two spokes 128 and 130 extending to the inner wall of section 112. Spokes 128 and 130 further create three apertures 132, 134 and 136.

Figure 1C:
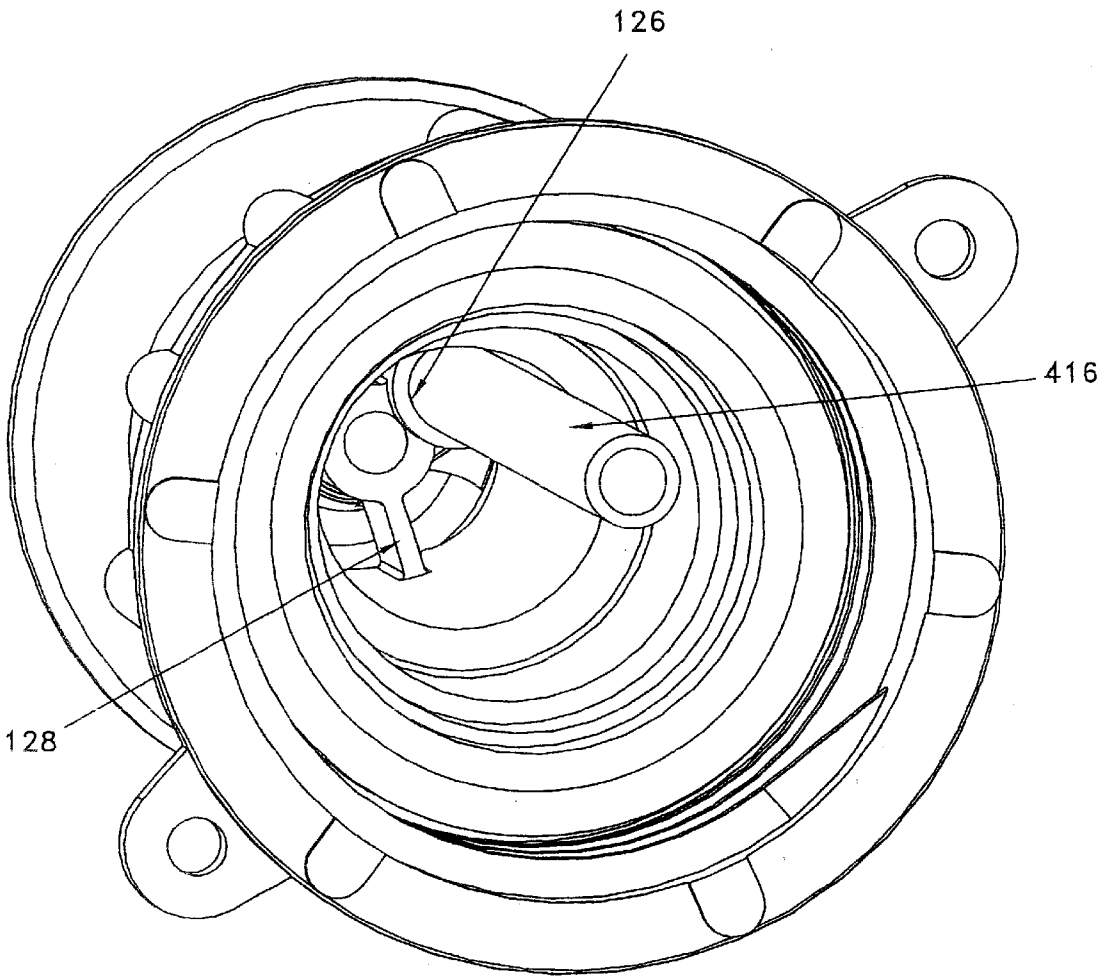
FIG. 1*c* is a perspective view of the inner sleeve of the assembled pour spout of FIG. 1*a*, seen from the flange end.

FIG. 1*c* is a perspective view of the inner sleeve of the assembled pour spout of FIG. 1*a* seen from the flange end. As can be seen in FIG. 1*c*, the circular aperture 126 is for the air channel, and circular aperture 126 is sized to accept the end of a flexible rubber tube 416. The preferred diameter of aperture 126 is in the range of 0.240 inches to 0.250 inches (6.1 mm to 6.35 mm), although this diameter may vary in many embodiments.

Turning back to FIG. 1*a*, central tube 127 may be seen to extend out past end 124 of section 112. Inner sleeve 110 is placed though annular threaded cap 138. Threaded cap 138 has shoulders (not shown in FIG. 1*a*) sized to rest on flange 120 as covered by rubber o-ring 122. A spring 156 is placed about end 127 of inner sleeve 110, and is sized to rest on shoulder 157 between sections 112 and 114 of inner sleeve 110.

Spout 108 also has an end-cap 140, o-ring 142, and a tubular outer sleeve 144. End-cap 140 and o-ring 142 are preferably of equal diameter to end 146 of outer sleeve 144; although the end-cap 140 will still function as long as end-cap 140 and o-ring 142 are of a larger diameter than the inner diameter of end 146 of outer sleeve 144. Outer sleeve 144 has a protrusion 148, and keyways 149 and 151. In this embodiment, protrusion 148 is a flange extending around the circumference of outer sleeve 144: however, any protrusion that will activate the slide valve by pressing against an outlet port of a container will suffice.

Flow diverter 150 is sized in diameter to fit through plastic ring 154 and o-ring 152 and end 146 of outer sleeve 144. Flow diverter 150 has a cylinder through its center of a diameter to accommodate end 127 of inner sleeve 110. Flow diverter 150 also has a recess or slot 153.

A screw (not shown) is passed through end-cap 140, o-ring 142, outer sleeve 144, o-ring 152 plastic ring 154, flow diverter 150 and spring 156 and screwed into end 127 of inner sleeve 110. When this occurs, recess or slot 153 of flow diverter 150 lines up with circular aperture 126. Also, one end of spring 156 rests against shoulder 157 and the other end rests against plastic ring 154. Plastic ring 154 in turn rests upon a shoulder (not shown) inside outer sleeve 144 forming a fluid-tight bond with o-ring 152, as will be further described in the description of FIG. 4. Inner sleeve 110, outer sleeve 144, spring 156 and end-cap 140 and o-ring 142 form a slide valve, with the spring biasing outer sleeve 144 into a fluid-tight position against end-cap 140 and o-ring 142.

Figure 2B:
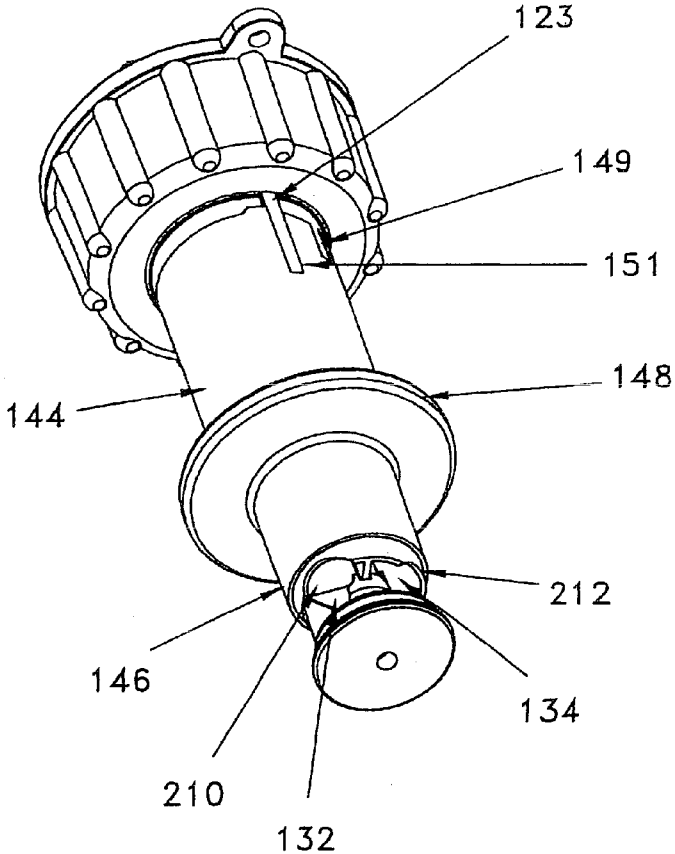
FIG. 2*b* is a perspective view of the pour spout of FIG. 1*a* with the slide valve open.
Figure 2A:
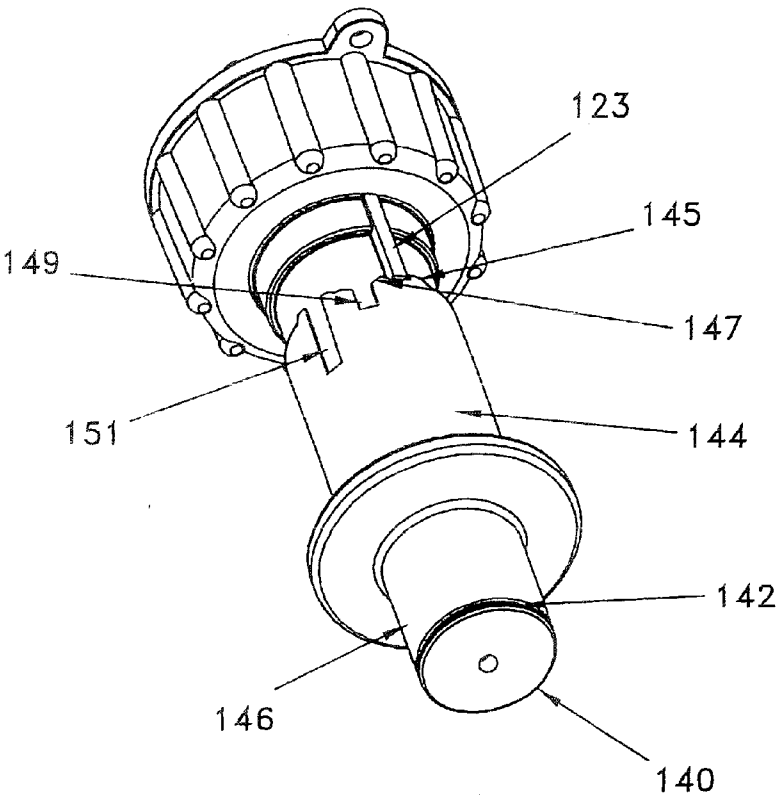
FIG. 2*a* is a perspective view of the pour spout of FIG. 1*a* with the slide valve closed, showing the keyways.

FIGS. 2*a* and 2*b* show spout 108 with the slide valve closed and open respectively. Turning to FIG. 2*a*, spring 157 (not shown) has biased outer sleeve 144, and more specifically end 146, into a fluid-tight position against end-cap 140 and o-ring 142. In addition, keyways 149 and 151 are not in a position to accept key 123. Instead, key 123 is positioned between bosses 145 and 147, preventing outer sleeve 144 from rotating freely relative to inner sleeve 110. Turning to FIG. 2*b*, the slide valve has been opened, which is generally accomplished by rotating outer sleeve 144 past bosses 145 and 147 to allow key 123 to ride in keyway 149 or, as shown in FIG. 2*b*, 151, and then applying pressure to protuberance 148. End 146 of outer sleeve 144 has pulled away from o-ring 142, exposing apertures 132 and 134, as well as the other apertures (not shown) from inner sleeve 110. Note that apertures 132 and 134 have contiguous cut-away sections 210 and 212 cut away from inner sleeve 110. In the preferred embodiment, these are shaped as half-disks, although other shapes could possibly be used. The function of these cut-away sections 210 and 212 will be further described in the discussion of FIG. 6.

Figure 2C:
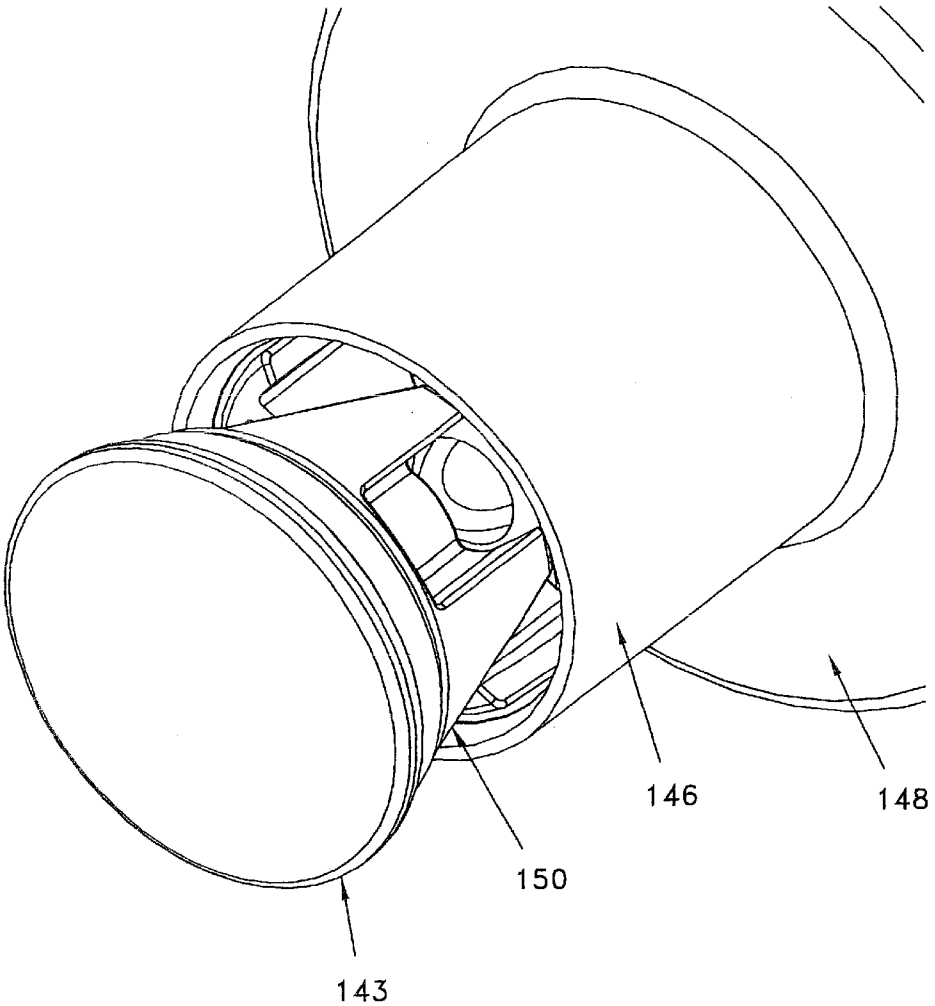
FIG. 2*c* is a perspective view of the pouring end of an alternative assembly of the pour spout of FIG. 1*a;*

In an alternative embodiment, illustrated in FIG. 2*c*, o-ring 142 may be incorporated into flow diverter 150. The one-piece end-cap 143 has a central knob which is sonic welded to end 127 of inner sleeve 110 through flow diverter 150. This assembly fits within end 146 of outer sleeve 144.

Figure 3:
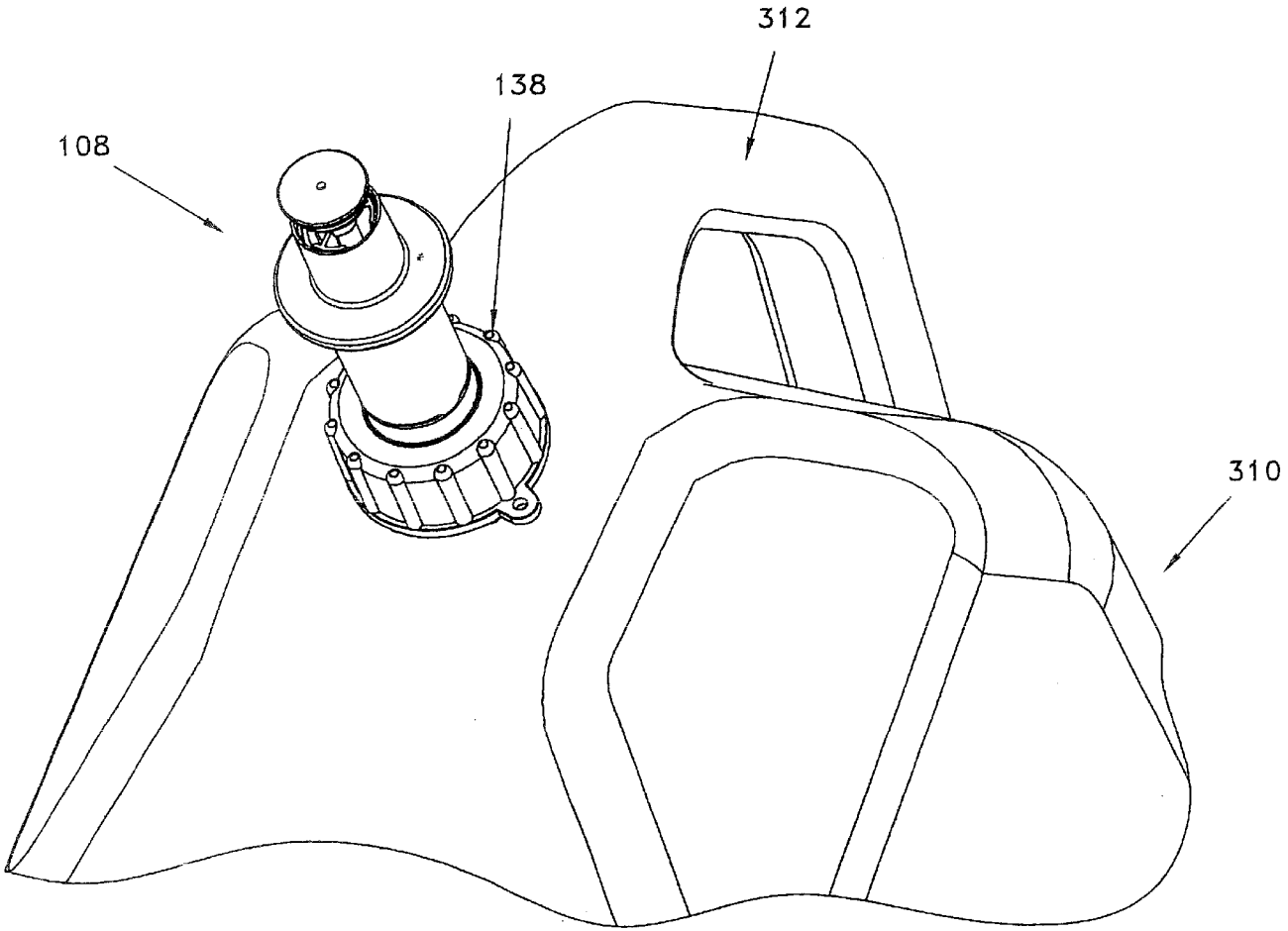
FIG. 3 is a perspective view of the pour spout of FIG. 1*a* attached to a container with the slide valve open.

FIG. 3 is a perspective drawing of the spout installed on a typical container. Turning to FIG. 3, container 310 has an outlet port (not shown), typically located near the top of the container in line with handle 312. Handle 312 is typically hollow. Threaded cap 138 has been screwed onto the correspondingly threaded outlet port of the container to form a fluid-proof connection. Note that the slide valve for spout 108 is drawn in the open position.

Figure 4:
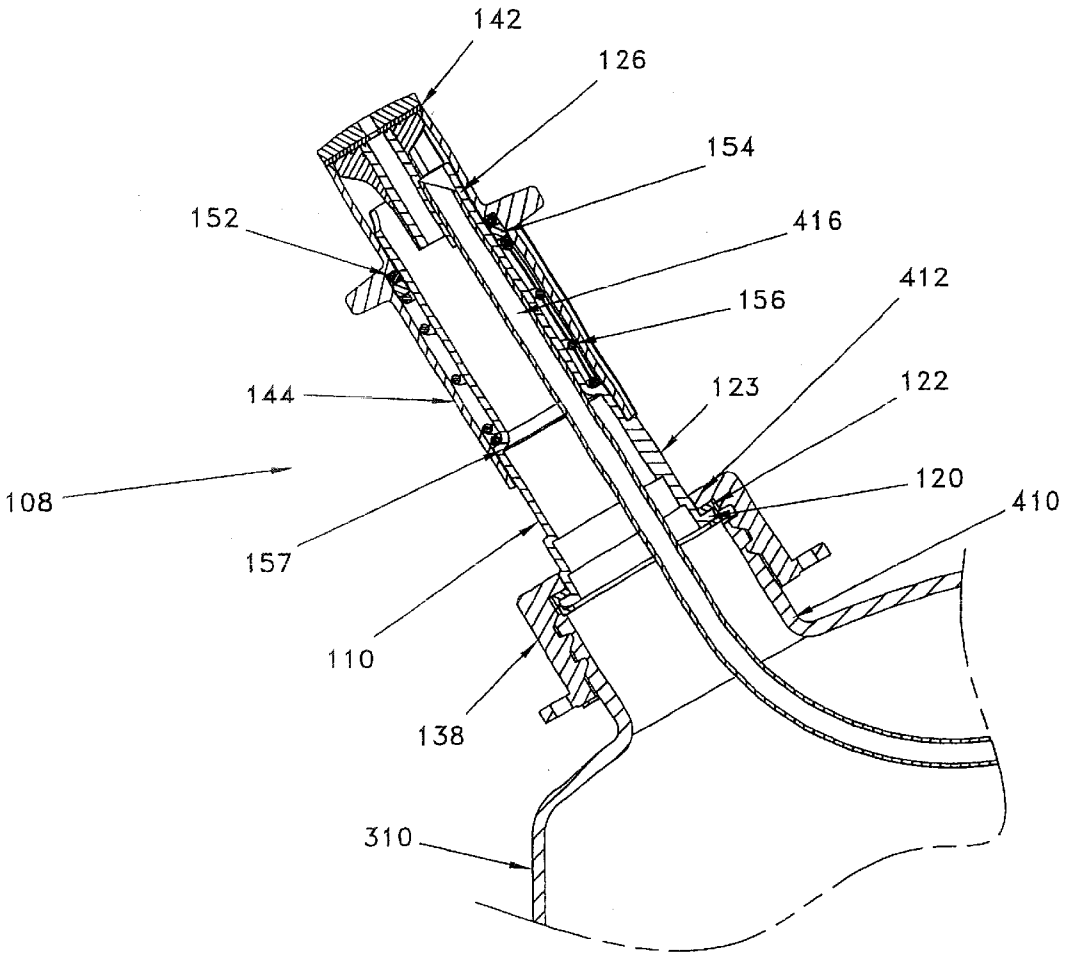
FIG. 4 is a cross-sectional view of the pour spout of FIG. 1*a;*

FIG. 4 shows a cross-section of the spout of FIG. 1*a* attached to the container as shown in FIG. 3, with the slide valve in the closed position. Turning to FIG. 4, container 310 has a threaded outlet port 410. Spout 108 is attached to outlet port 410 by threading annular threaded cap 138 to outlet port 410. Threaded cap 138 has a shoulder 412 sized to rest on rubber o-ring 122 covering flange 120. This forms a fluid-tight seal between inner sleeve 110 and outlet port 410. As noted above, inner sleeve 110 has a key 123.

Spring 156 extends to shoulder 157 and plastic ring 154. Plastic ring 154 is seated against shoulder 414 of outer sleeve 144. Shoulder 414 also holds o-ring 152 in place between outer sleeve 144 and inner sleeve 110, forming a fluid-tight and airtight seal. Spring 156 thus biases outer sleeve 144 into a fluid-tight and airtight contact with o-ring 142.

As may be seen in FIG. 4, circular aperture 126 extends some distance into inner sleeve 110, where it connects to a flexible tube 416.

The spout in operation is explained with reference to FIGS. 5*a* and 5*b*. Turning to FIG. 5*a*, container 310 and spout 108 have been tipped. Gasoline 510 (shown in the diagram with horizontal dashes) has filled the inner, hollow space in inner sleeve 110. However, circular aperture 126 and flexible tube 416 do not contain gasoline, but contain air. Note that in FIG. 5*a*, the slide valve is closed, and gasoline 510 cannot flow from spout 108.

Figure 5B:
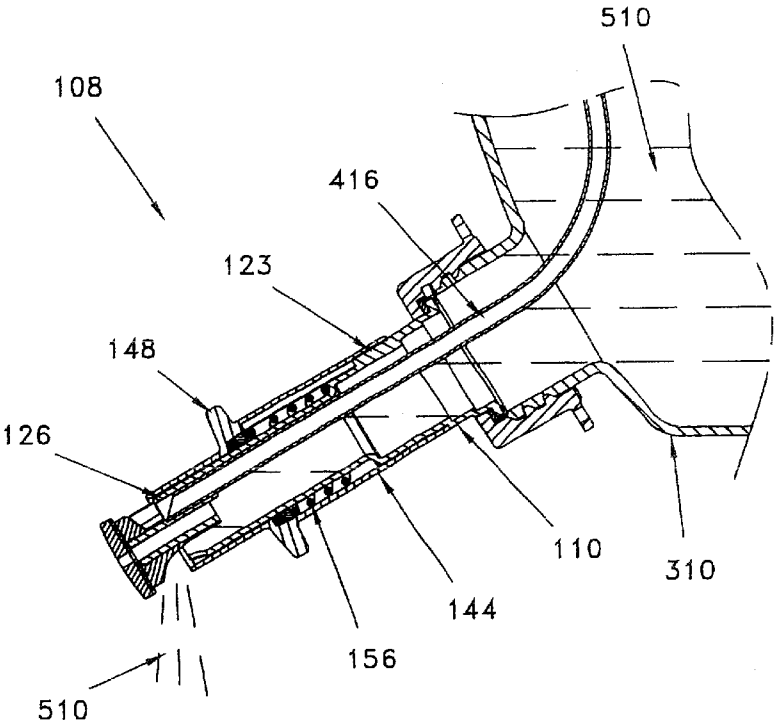
FIG. 5*b* is a cross-sectional view of the pour spout of FIG. 1*a*, attached to a container, with the slide valve open.
Figure 5A:
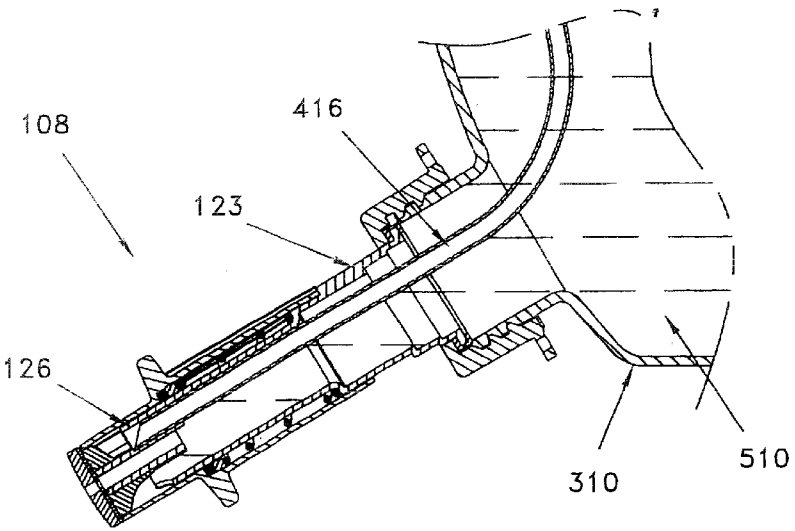
FIG. 5*a* is a cross-sectional view of the pour spout of FIG. 1*a*, attached to a container, with the slide valve closed.

Turning to FIG. 5*b*, the slide valve has been opened. In operation, this is caused by resting a portion (or all) of the weight of container 310 on the rim on an inlet port to a gas tank via protuberance 148 and rotating outer sleeve 144 so that key 123 on inner sleeve 110 can access keyway 149 or 151. Outer sleeve 144 has slid up inner sleeve 110, compressing spring 156, and exposing apertures 126, 132, 134 and 136. Gasoline 510 may now flow out of apertures 132, 134 and 136, and air may now flow into circular aperture 126.

In operation, when spout 108 is inserted into a gas tank and the slide valve is opened, apertures 126, 132, 134 and 136 (shown in FIG. 1*b*) will normally be above the level of gasoline in the gas tank (the receiving vessel, not shown). Gasoline 510 will begin to flow out of apertures 132, 134 and 136, and air begins to flow into circular aperture 126. Since flexible tube 416 exits inside container 310, this will generally serve to equilibrate the air pressures inside and outside container 310, and the gasoline pour will be relatively smooth or free of "glugging".

It is thought that tube 416 should be short enough that the exit of tube 416 does not extend past the annular threaded cap 138 when annular threaded cap 138 is attached to an outlet port. However, as will be noted below, the exit of tube 416 may be positioned inside container 310.

At some point, the gas tank (not shown) will be filled to the point where the level of gasoline blocks circular aperture 126. When this happens, airflow into container 310 is cut off A pressure imbalance will develop between the ambient air pressure and the air pressure in container 310, (with a lower pressure inside container 310), and the flow of gasoline through apertures 132, 134 and 136 will cease. When this happens, spout 108 may be withdrawn from the inlet port of the gas tank, and the slide valve will close to prevent any further pouring or splashing. The level to which the gasoline in the gas tank must rise before reaching circular aperture 126 is determined by the length of the keyway 149 or 151 into which key 123 travels, allowing outer sleeve 144 to move by inner sleeve 110 when a pressure is placed on protuberance 148. If keyways 149 and 151 are of different lengths, the user of spout 108 may choose the maximum height to which the gasoline in the gas tank may be filled by rotating outer sleeve 144 to choose either keyway 149 or 151. The designer of the spout may allow the user to choose between several heights to which the gasoline in the gas tank may be filled by introducing several keyways of different lengths in the outer sleeve 144.

If the spout is appropriately designed, the lengths of keyways 149 and 151 may also be used to control the flow rate of liquid flowing through spout 108. Air flows into circular aperture 126 via recess or slot 153 in flow diverter 150. If, when inner sleeve 110 is fully extended past outer sleeve 144, recess or slot 153 is partially covered by outer sleeve 144, the flow-rate of air into circular aperture 126 will be restricted, which in turn will constrain the flow-rate of liquid through inner sleeve 110. Through the use of keyways of different lengths, the designer of a spout may cover recess or slot 153 in different amounts and thus influence the flow-rate of liquid through inner sleeve 110.

Alternatively, any means may be used to stop the outer sleeve 144 from sliding past inner sleeve 110 at a selected position, and any means may be used to select from between at least two positions, while still falling within the scope of the invention. A keyway could be on the inner sleeve and the key on the outer sleeve. A system of blocks and stops could also be used, although it is not thought this would be preferred.

Figure 6:
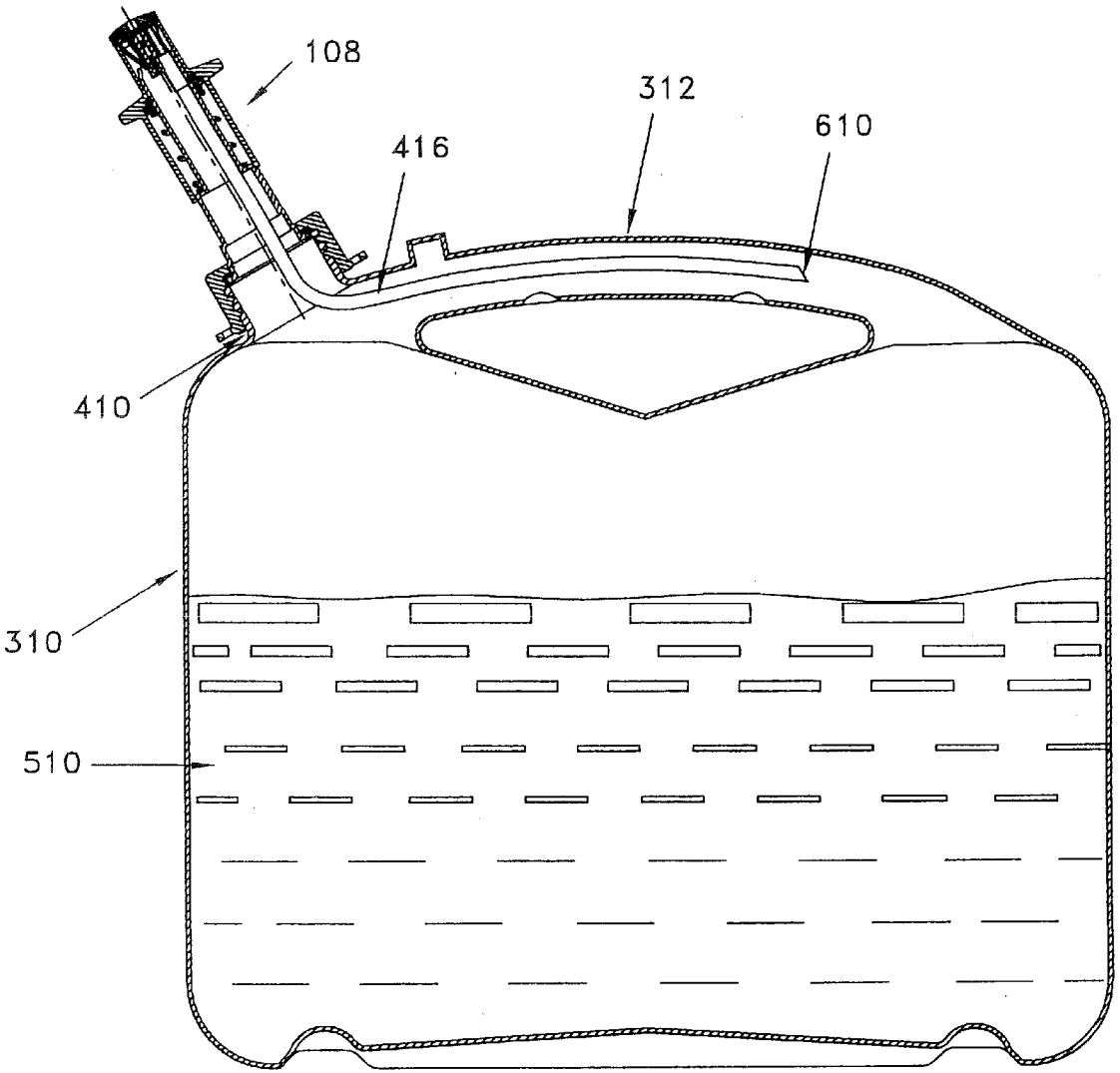
FIG. 6 is a cross sectional view of the pour spout of FIG. 1*a* attached to a container, detailing the placement of the air tube.

The "anti-glug" feature of this spout works best when liquids (including gasoline) are kept out of the air channel, as shown in FIG. 6. Turning to FIG. 6, spout 108 is shown attached to outlet port 410 of container 310. In this configuration, end 610 of tube 416 is located in the hollow handle 312, to attempt to keep end 610 out of gasoline 510 during both pouring and storage. End 610 of the flexible tube 416 may be mitred, or it may be cut in an irregular fashion, including cut to a point, or it may be square-cut.

For economic and practical purposes it is desirable that: (1) the outer diameter of inner sleeve 110 be small enough to fit into gas tank openings as small as 23 mm in diameter; and (2) the tube 416 be made of a generally commercially available size, such as a flexible tube with a ¼ inch outer diameter and a 1/32 to 3/64 inch wall. It has been discovered that using cut-away sections, such as sections 132 and 134, allows a greater steady-state flow-rate (all as compared to a tube of the same diameter without cut-away sections). It is also believed that that using cut-away sections allows for a smoother start to the pour, and allows the maximum flow-rate to be more quickly achieved from the start of the pour. The use of cut-away sections facilitates an acceptable minimum flow-rate under the constraints (1) and (2) listed above. Although the cut-away sections in the illustrated embodiment are semi-circular in shape, a person skilled in the art would realize that other shapes could also be used.

The use of cut-away sections contiguous to the exits also has another advantage. "Bubbles" of gasoline in air tube 416 would impede the flow of air and impede the efficiency of the pouring system. As a result, flow diverter 150 is designed to direct the flow of gasoline out of spout 108 away from air entrance 126. However, when the gasoline (or other liquid being poured) hits the flow diverter, this causes back pressure in the gasoline, slowing the flow out of spout 108. The cut-away sections allow more of the gasoline to exit the spout without hitting flow diverter 150, and also direct the flow of gasoline away from air entrance 126.

Figure 7:
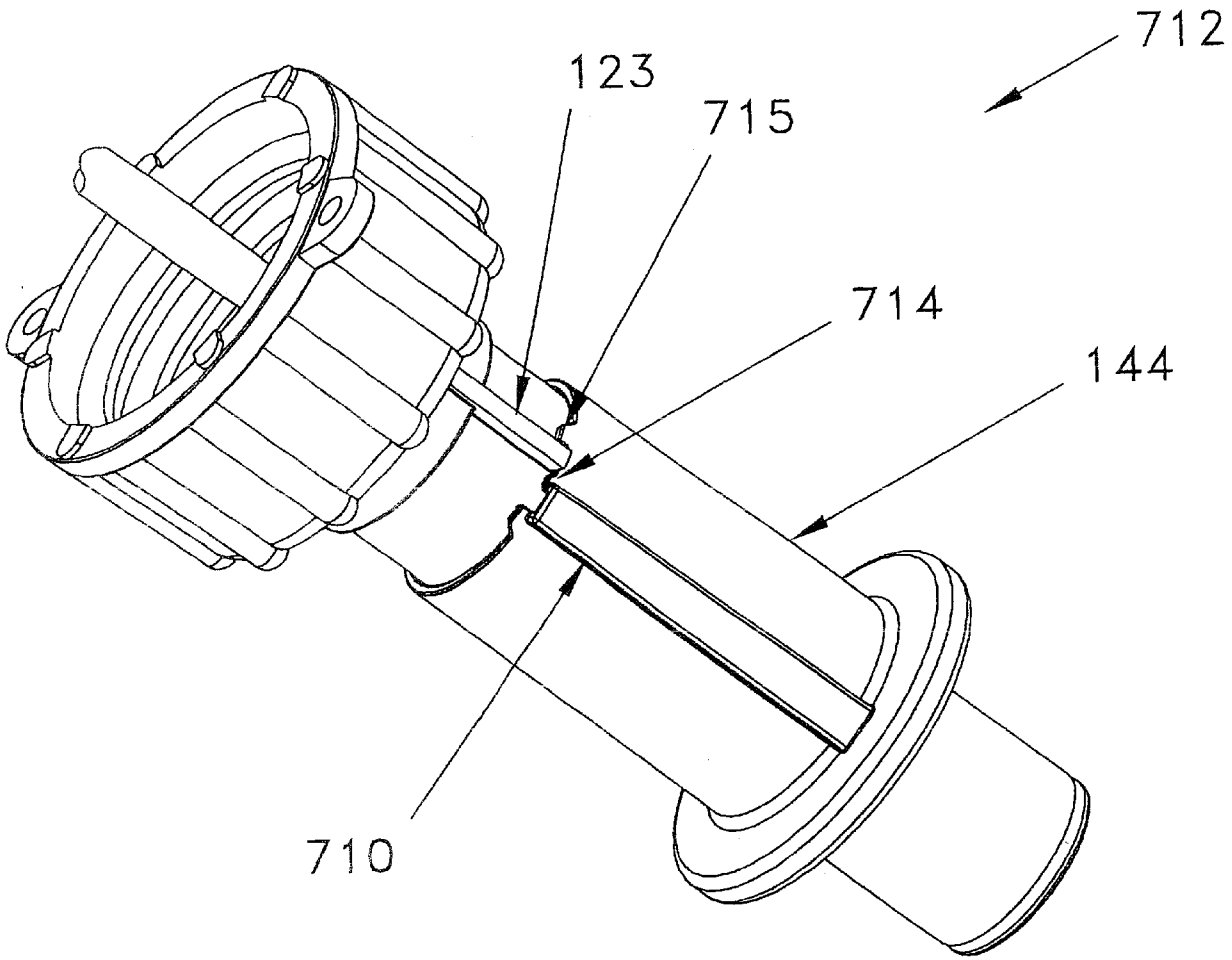
FIG. 7 is a perspective view of an alternative embodiment of the pour spout, with a raised keyway.

As shown in the figures but most clearly seen in FIG. 2*a*, keyways 149 and 151 are shown as cut out of the surface of outer sleeve 144. Alternatively, as shown in FIG. 7, the keyways may be sections 710 raised from the surface of outer sleeve 144 a sufficient height to permit the passage of key 123. In FIG. 7, there is only one keyway, so the pour spout 712 can only be set to cut of liquid from the pour spout into a container at one level. Note bosses 714 and 715, which hold outer sleeve 144 in place when the pour spout is closed.

Figure 8:
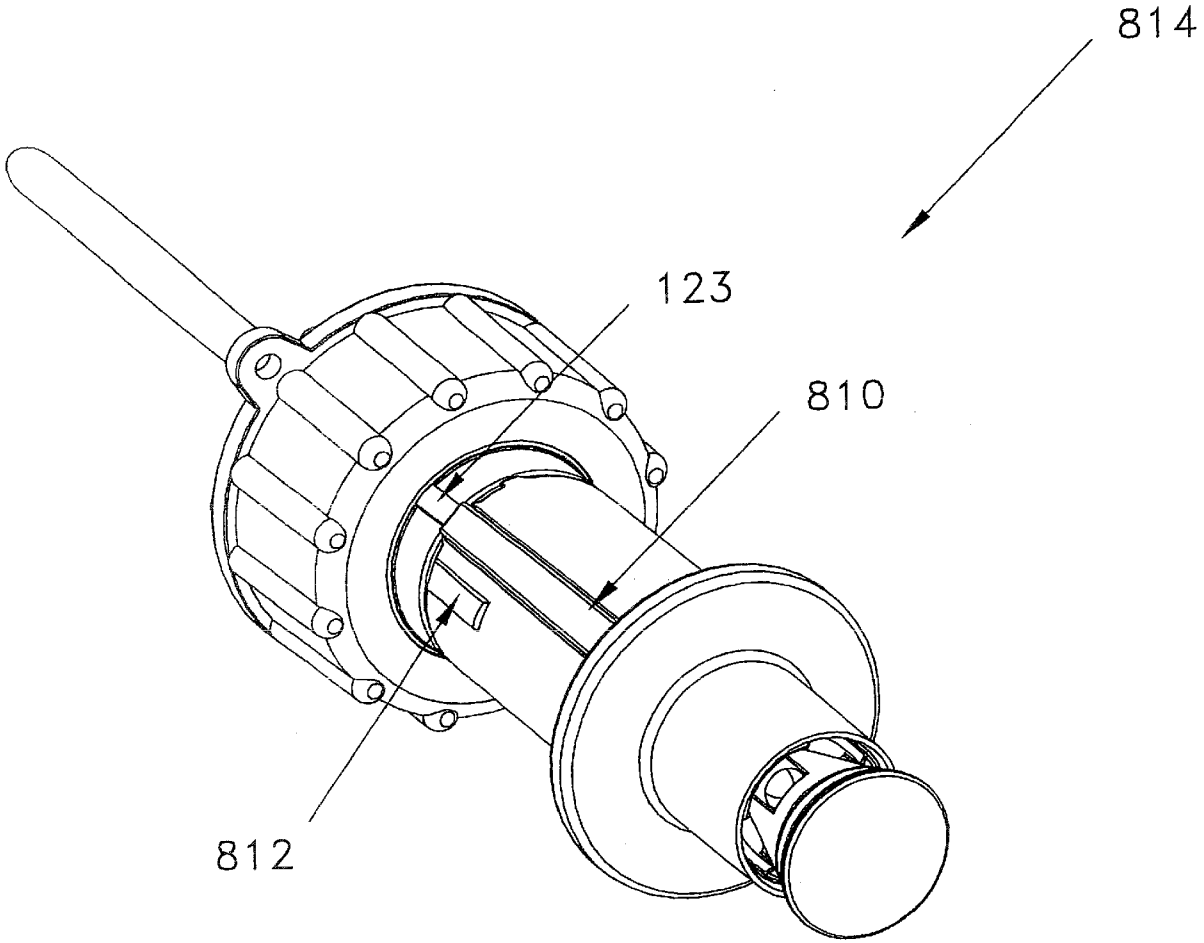
FIG. 8 is a perspective view of an alternative embodiment of the pour spout of FIG. 1*a* with raised keyways.

As shown in FIG. 8, two raised keyways 810 and 812 of differing lengths, allowing the user of pour spout 814 to choose the maximum height to which the gasoline in the gas tank may be filled by rotating outer sleeve 144 to choose either keyway 810 or 812. The designer of the spout may allow the user to choose between several heights to which the gasoline in the gas tank may be filled and/or to choose between different maximum flow-rates by introducing several keyways of different lengths in the outer sleeve 144.

There are a number of different types of key and keyway combinations that perform the same function as key 123 and keyways 149 and 151 or keyways 810 and 812, and their use falls within the spirit of the invention. Alternatively, any means may be used to stop the outer sleeve 144 from sliding past inner sleeve 110 at a selected position, and any means may be used to select from between at least two positions, while still falling within the scope of the invention. A keyway could be on the inner sleeve and the key on the outer sleeve. A system of blocks and stops could also be used, although it is not thought this would be preferred.

It will be noted by a person skilled in the art that the cut-away sections could be used as described herein without a means for stopping the outer sleeve 144 from sliding past inner sleeve 110 at at least two pre-selected positions. Similarly, a person skilled in the art would realize that a means for stopping the outer sleeve 144 from sliding past inner sleeve 110 at at least two pre-selected positions could be used as described herein without the cut-away sections.

It is noted that those skilled in the art will appreciate that various modifications of detail may be made to the preferred embodiments described herein, which would come within the spirit and scope of the invention as described in the following claims.

What is claimed is:

1. A spout comprising:

a tubular inner sleeve for pouring liquids through an intake end of the sleeve to a pouring end of the sleeve;

the inner sleeve positioned within a larger tubular outer sleeve, so that the outer sleeve is positioned for movement along the outside of the inner sleeve;

the pouring end of the inner sleeve having at least two apertures and an end-cap larger than the inner diameter of the end of the outer sleeve closest to the pouring end of the inner sleeve;

the outer sleeve being biased towards the end-cap to form a slide valve; and a stop mechanism to prevent movement of the inner sleeve in the direction of the pouring end relative to the outer sleeve in at least two pre-selected positions.

2. The spout of claim 1 further comprising the outer sleeve rotating relative to the inner sleeve to select one of the pre-selected positions.

3. The spout of claim 2 wherein the stop mechanism further comprises at least two keyways in the outer sleeve and a key on the inner sleeve.

4. The spout of claim 1 wherein the outer sleeve has a protrusion for catching upon the rim of the inlet port of a container.

5. The spout of claim 3 wherein the protrusion is a flange.

6. The spout of claim 1 wherein the diameter of the pouring end of the inner sleeve is small enough in diameter to fit through the inlet port of a container and the outer sleeve is larger in diameter than the inlet port of the container.

7. The spout of claim 1 wherein the outer sleeve has at least two sections of unequal diameter, and the section of the outer sleeve at the end closest to the pouring end of the inner sleeve being smaller in diameter than at least one other section.

8. The spout of claim 1 wherein the intake end of the inner sleeve is attached to a port of a container.

9. The spout of claim 1 further comprising the sleeve having at least one cut away section, cut away from the sidewalls of the sleeve contiguous with at least one aperture.

10. The spout of claim 9 further comprising a tube inside the inner sleeve and attached to an aperture that is not contiguous to a cut away section.

11. The spout of claim 10 wherein the tube is flexible.

12. The spout of claim 1 wherein there is a flow diverter between the at least two apertures and the end cap.

13. The spout of claim 12 wherein the flow diverter has a recess for air flow which is partially covered when the inner sleeve and outer sleeve are in at least one of the at least two pre-selected positions.

14. A spout comprising:

a first tubular sleeve for pouring liquids, the sleeve having an intake end and a pouring end, the pouring end having side walls and an end wall;

the end wall having at least two apertures there through;

the first sleeve having at least one cut away section, cut away from the sidewalls of the first sleeve contiguous with at least one aperture;

a channel connected to at least one aperture, the at least one aperture connected to the channel not being contiguous with a cut away section;

the cut away section being sized to create a specific ratio of the effective cross-sectional area of the channel to the effective cross-sectional area of the apertures including the cut away section not connected to the channel.

15. The spout of claim 14 wherein the spout further comprises: a flexible tube being connected to the channel, the flexible tube having an end connected to the channel and an end not connected to the channel.

16. The spout of claim 15 wherein the spout further comprises:

the end of the flexible tube not connected to the channel being mitred.

17. The spout of claim 15 wherein the spout further comprises:

the end of the flexible tube not connected to the channel being irregularly cut.

18. The spout of claim 14 attached to a container.

19. The spout of claim 14, wherein the cut away section is a semi circle in shape.

20. A spout comprising:

a first tubular sleeve for pouring liquids, the sleeve having an intake end and a pouring end, the pouring end having side walls and an end wall;

the end wall having at least two apertures there through;

the first sleeve having at least one cut away section, cut away from the sidewalls of the first sleeve contiguous with at least one aperture;

the first sleeve positioned within a larger tubular outer second sleeve, so that the second sleeve is positioned for movement along the outside of the first sleeve;

the pouring end of the first sleeve having an end-cap larger than the inner diameter of the end of the second sleeve closest to the pouring end of the first sleeve;

the second sleeve being biased towards the end-cap to form a slide valve; and a stop mechanism to prevent movement of the first sleeve in the direction of the pouring end relative to the second sleeve in at least two pre-selected positions.

21. The spout of claim 20 further comprising the second sleeve rotating relative to the first sleeve to select one of the pre-selected positions.

22. The spout of claim 21 wherein the stop mechanism further comprises at least two keyways in the second sleeve and a key on the first sleeve.

23. The spout of claim 20 wherein the second sleeve has a protrusion for catching upon the rim of the inlet port of a container.

24. The spout of claim 23 wherein the protrusion is a flange.

25. The spout of claim 20 wherein there is a flow diverter between the at least two apertures and the end cap.

26. The spout of claim 25 wherein the flow diverter has a recess for air flow which is partially covered when the inner sleeve and outer sleeve are in at least one of the at least two pre-selected positions.

* * * * *